US005104130A

United States Patent [19]

Francin

[11] Patent Number: 5,104,130

[45] Date of Patent: Apr. 14, 1992

[54] BOCCE COURT CONSTRUCTION WITH A RUBBER SURFACE

[76] Inventor: Rudy Francin, 158-42 95th St., Howard Beach, N.Y. 11414

[21] Appl. No.: 683,848

[22] Filed: Apr. 11, 1991

[51] Int. Cl.[5] ..... A63D 1/00

[52] U.S. Cl. ..... 273/411; 273/51

[58] Field of Search ..... 273/411, 51, 176 R, 273/176 G, 178 B

[56] References Cited

U.S. PATENT DOCUMENTS

| | | | |
|---|---|---|---|
| 1,763,782 | 6/1930 | Henderson et al. | 273/411 X |
| 1,965,055 | 7/1934 | Purnell | 273/51 |
| 2,353,598 | 7/1944 | Somerville | 273/51 |
| 2,531,168 | 11/1950 | Snyder | 273/51 |
| 2,992,001 | 7/1961 | Ferris, Jr. | 273/51 X |
| 3,312,469 | 4/1967 | Clayton | 273/51 |
| 3,735,988 | 5/1973 | Palmer | 273/178 B |
| 3,858,887 | 1/1975 | Wallin | 273/176 G |
| 4,850,594 | 7/1989 | Manzione | 273/176 R |

*Primary Examiner*—William H. Grieb
*Attorney, Agent, or Firm*—Richard L. Miller

[57] ABSTRACT

A bocce court construction with a rubber surface is provided and consists of a long narrow rectangular concrete floor formed on an open level surface, a long narrow rectangular seamless hard rubber mat sized to fit over and be secured to the concrete floor, a pair of sideline walls, each secured on a long side of the concrete floor, proximate a long side of the rubber mat and a pair of parapets, each secured on a short end of the concrete floor, proximate a short end of the rubber mat. The sideline walls and the parapets will indicate in combination a playing area for the bocce court, so that a plurality of wooden balls can each be pitched by players onto the playing area towards one of the parapets to play the game of bocce.

6 Claims, 2 Drawing Sheets

BOCCE COURT CONSTRUCTION WITH A RUBBER SURFACE

BACKGROUND OF THE INVENTION

The instant invention relates generally to outdoor game playing surfaces and more specifically it relates to a bocce court construction with a rubber surface. Numerous outdoor game playing surfaces have been provided in the prior art that are adapted to be utilized for the game of golf. For example, U.S. Pat. No. 3,735,988 to Palmer et al; U.S. Pat. No. 3,858,887 to Wallin and U.S. Pat. No. 4,850,594 to Manzione all are illustrative of such prior art. While these units may be suitable for the particular purpose to which they address, they would not be suitable for the purpose of the present invention as hereafter described.

SUMMARY OF THE INVENTION

A primary object of the present invention is to provide a bocce court construction with a rubber surface that will overcome the shortcomings of the prior art devices.

Another object is to provide a bocce court construction with a rubber surface in which a seamless hard rubber mat is secured onto a long narrow concrete open level playing area that will eliminate the dirt or clay surface the bocce game is normally played on.

An additional object is to provide a bocce court construction with a rubber surface in which the playing area includes a pair of sideline walls and a pair of parapets at the end of the court to indicate the area of which wooden balls of the game of bocce is to be played on.

A further object is to provide a bocce court construction with a rubber surface that is simple and easy to use.

A still further object is to provide a bocce court construction with a rubber surface that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
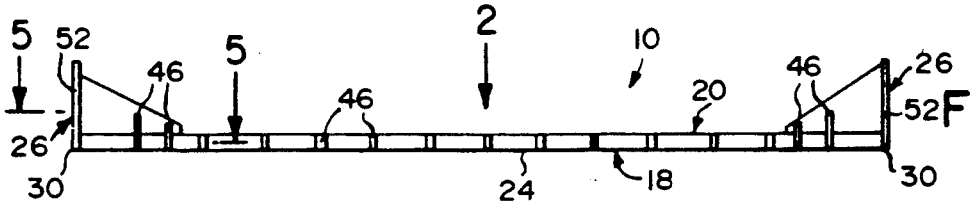
FIG. 1 is a side view of the instant invention.
Figure 2:
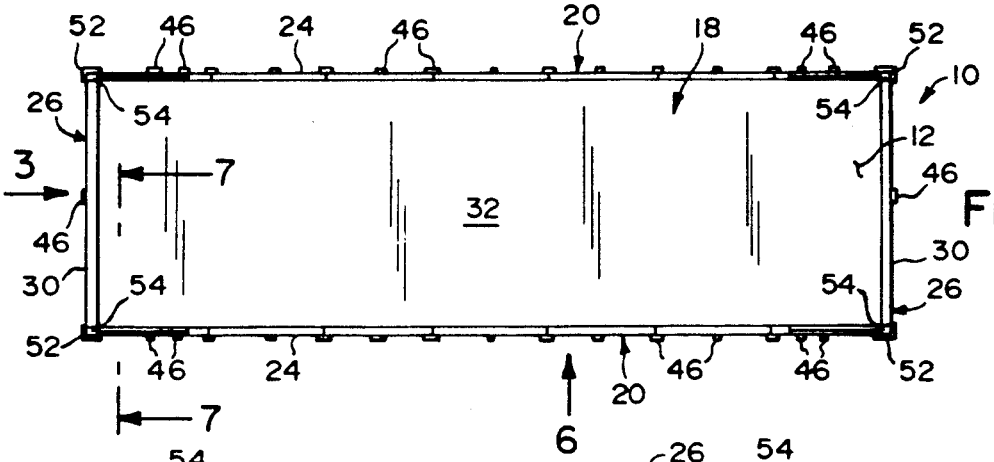
FIG. 2 is a top view taken in the direction of arrow 2 in FIG. 1.
Figure 3:
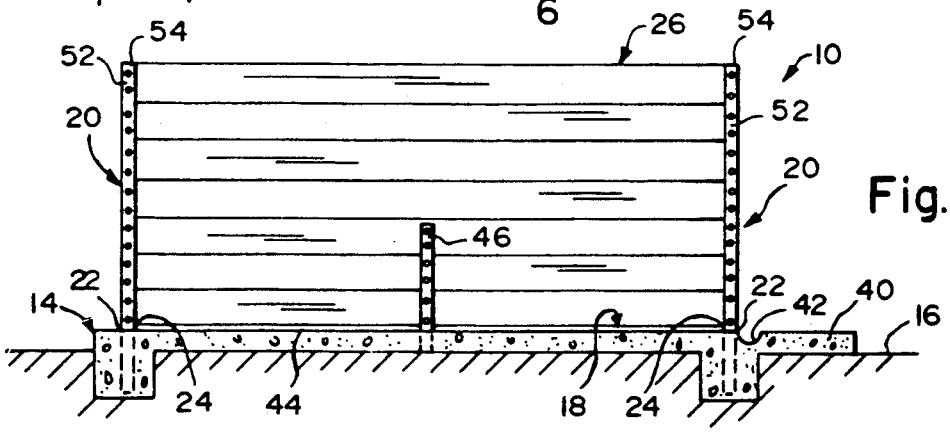
FIG. 3 is an enlarged end view taken in the direction of arrow 3 in FIG. 2.
Figure 4:
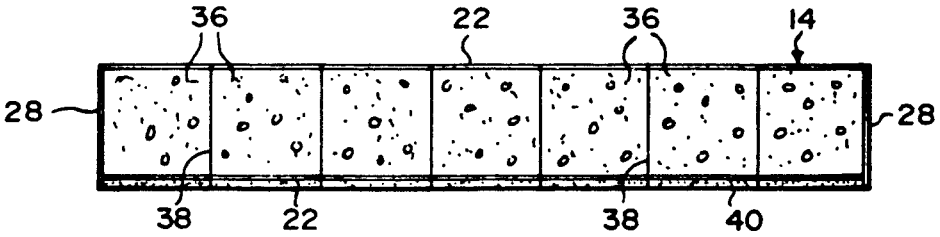
FIG. 4 is a diagrammatic top view showing the overall extension of the concrete floor.
Figure 5:
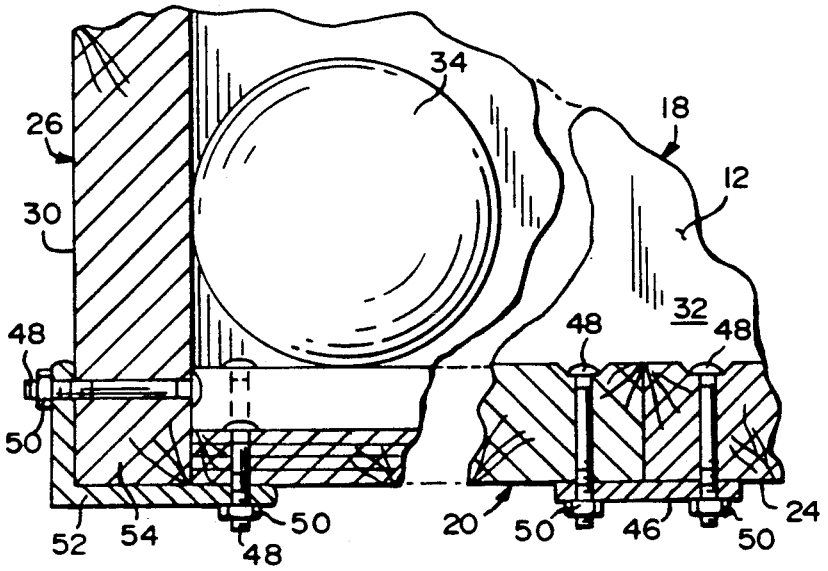
FIG. 5 is a greatly enlarged cross sectional view taken along Line 5—5 in FIG. 1 with parts broken away.
Figure 6:
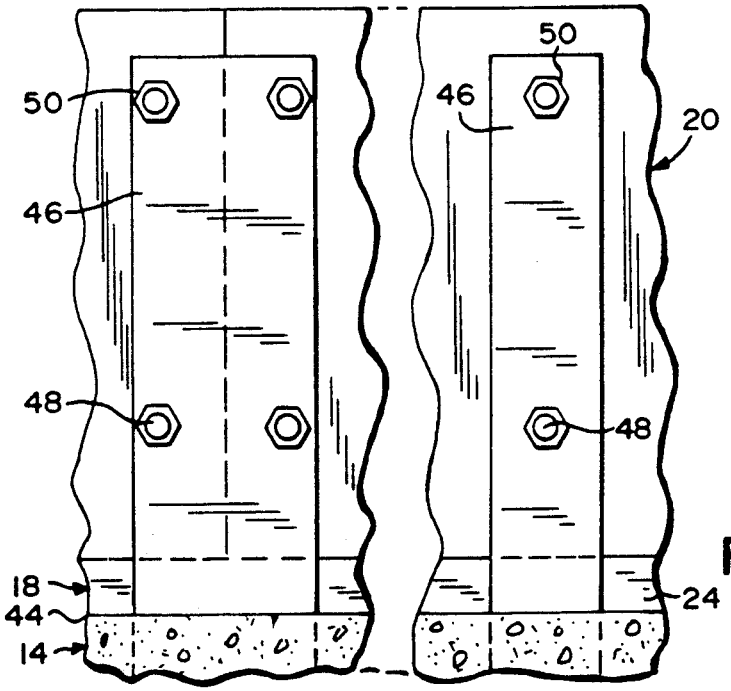
FIG. 6 is a greatly enlarged side view taken in the direction of arrow 6 in FIG. 2 with parts broken away showing two typical side bars.
Figure 7:
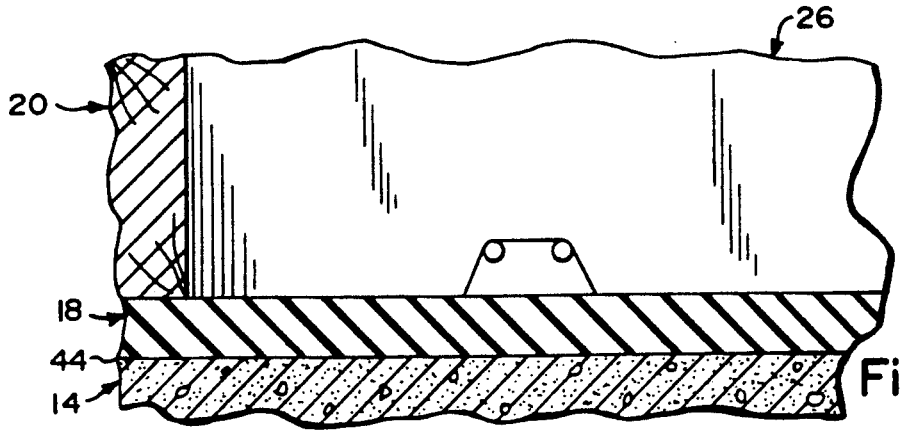
FIG. 7 is an enlarged cross sectional view taken along line 7—7 in FIG. 2 showing drainage holes therein.

Turning now descriptively to the drawings, in which like reference characters denote like elements throughout the several views, the Figures illustrate a bocce court construction 10 with a rubber surface 12 consisting of a long narrow rectangular concrete floor 14 formed on an open level surface 16, such as the ground. A long narrow rectangular seamless hard rubber mat 18 is sized to fit over and be secured to the concrete floor 14. A pair of sideline walls 20, are each secured on a long side 22 of the concrete floor 14, proximate a long side 24 of the rubber mat 18. A pair of parapets 26, are each secured on a short end 28 on the concrete floor 14, proximate a short end 30 of the rubber mat 18. The sideline walls 20 and the parapets 26 will indicate in combination a playing area 32 for said bocce court 10, so that a plurality of wooden balls 34 can each be pitched by players onto the playing area 32 towards one of the parapets 26 to play the game of bocce.

The concrete floor 14 includes a plurality of generally square shaped panel segments 36 in a side by side relationship therealong and a plurality of asphalt divider strips 38, each positioned between each of the panel segments 36 on the concrete floor 14.

The concrete floor 14 further includes an elongated concrete walkway 40 extending outside and along one of the side walls 20, with the walkway 40 having a built in gutter 42 running proximate the side wall 20 for drainage of water therefrom. Adhesive 44 is employed to secure the rubber mat 18 onto the concrete floor 14 in the playing area 32 thereof.

Each sideline wall 20 includes a plurality of anchor bars 46, each affixed in a spaced apart relationship into the concrete floor 14 and extends upwardly outside the sideline wall 20. A plurality of bolts 48, each extends through the sideline wall 20 and out of one of the anchor bars 46. A plurality of nuts 50 are each threaded onto a distal end of one bolt 48 on the outside of the sideline wall 20 so as to secure the sideline wall 20 thereto.

Each parapet 26 includes a pair of L-shaped corner posts 52, which are each affixed into the concrete floor 14 and extends upwardly outside a corner 54 of the parapet 26. A plurality of the anchor bars 46, are each affixed in a spaced apart relationship into the concrete floor 14 and extends upwardly outside the parapet 26. A plurality of the bolts 48, each extends through the parapet 26 and out one of the corner posts 52 and the anchor bars 46. A plurality of the nuts 50, are each threaded onto a distal end of one bolt 48 on the outside of the parapet 26 so as to secure the parapet 26 thereto.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A bocce court construction with a rubber surface comprising:

a) a long narrow rectangular concrete floor formed on an open level surface;

b) a long narrow rectangular seamless hard rubber mat sized to fit over and be secured to said concrete floor;

c) a pair of sideline walls, each secured on a long side of said concrete floor, proximate a long side of said rubber mat; and d) a pair of parapets, each secured on a short end of said concrete floor, proximate a short end of said rubber mat, in which said sideline walls and said parapets will indicate in combination a playing area for said bocce court, so that a plurality of wooden balls can each be pitched by players onto the playing area towards one of said parapets to play the game of bocce.

2. A bocce court construction as recited in claim 1, wherein said concrete floor includes:

a) a plurality of generally square shaped panel segments in a side by side relationship therealong; and b) a plurality of asphalt divider strips, each positioned between two of said panel segments of said concrete floor.

3. A bocce court construction as recited in claim 2, wherein said concrete floor further includes an elongated concrete walkway extending outside and along one of said side walls, with said walkway having a built in gutter running proximate said side wall for drainage of water therefrom.

4. A bocce court construction as recited in claim 3, further including adhesive to secure said rubber mat onto said concrete floor in the playing area thereon.

5. A bocce court construction as recited in claim 4, wherein each said sideline wall includes:

a) a plurality of anchor bars, each affixed in a spaced apart relationship into said concrete floor and extending upwardly outside said sideline wall;

b) a plurality of bolts, each extending through said sideline wall and out of one of said anchor bars; and c) a plurality of nuts, each threaded onto a distal end of one said bolt on the outside of said sideline wall so as to secure said sideline wall thereto.

6. A bocce court construction as recited in claim 5, wherein each said parapet includes:

a) a pair of L-shaped corner posts, each affixed into said concrete floor and extending upwardly outside a corner of said parapet;

b) a plurality of anchor bars, each affixed in a spaced apart relationship into said concrete floor and extending upwardly outside said parapet;

c) a plurality of bolts, each extending through said parapet and out of one of said corner posts and said anchor bars; and d) a plurality of nuts, each threaded into a distal end of one said bolt on the outside of said parapet so as to secure said parapet thereto.

* * * * *